US005205148A

United States Patent [19]

Heitze

[11] Patent Number: 5,205,148

[45] Date of Patent: Apr. 27, 1993

[54] UPSETTING PRESS FOR REDUCING THE WIDTH OF SLABS IN HOT-ROLLED WIDE STRIP BREAKING-DOWN TRAINS

[75] Inventor: Gerhard Heitze, Netphen, Fed. Rep. of Germany

[73] Assignee: SMS Schloemann-Siemag Aktiengesellschaft, Dusseldorf, Fed. Rep. of Germany

[21] Appl. No.: 787,054

[22] Filed: Nov. 4, 1991

[30] Foreign Application Priority Data

Nov. 3, 1990 [DE] Fed. Rep. of Germany ..... 4035001

[51] Int. Cl.[5] ..... B21J 13/08

[52] U.S. Cl. ..... 72/446; 72/206

[58] Field of Search ..... 72/184, 190, 206, 239, 72/406, 446

[56] References Cited

U.S. PATENT DOCUMENTS 3,665,746 5/1972 Eibe ..... 72/239
3,841,141 10/1974 Rachwal ..... 72/446
4,154,074 5/1979 Sieurin et al. ..... 72/239
4,852,383 8/1989 Nikaido et al. ..... 72/446

*Primary Examiner*—Lowell A. Larson
*Attorney, Agent, or Firm*—Anderson Kill Olick & Oshinsky

[57] ABSTRACT

An upsetting press for reducing the width of rolled material, particularly for reducing the width of slabs in hot-rolled wide strip breaking-down trains. The upsetting press includes tool carriers arranged on both sides of the slab and including pressing tools which can be moved in direction of slab reduction by at least one crank drive. The crank drive and a feeding drive are arranged in a crank housing. The crank housing with crank drive and feeding drive as well as the tool carrier are combined into a structural unit. This structural unit can be displaced on a rail arrangement laterally and approximately parallel to the slab movement through a housing post window of the horizontal press stand. The unit is displaceable particularly by a displacement drive.

11 Claims, 3 Drawing Sheets

UPSETTING PRESS FOR REDUCING THE WIDTH OF SLABS IN HOT-ROLLED WIDE STRIP BREAKING-DOWN TRAINS

BACKGROUND OF THE INVENTION

1. Field of the Invention

The present invention relates to an upsetting press for reducing the width of rolled material, particularly for reducing the width of slabs in hot-rolled wide strip breaking-down trains. The upsetting press includes tool carriers which are arranged on both sides of the slab edges and include pressing tools which can be moved in the direction of slab reduction by means of at least one crank drive. The crank drive and a feeding drive are arranged in a crank housing.

2. Description of the Related Art

In a flying upsetting press disclosed in German patent application P 39 17 398.4, for reducing the width of slabs in a hot-rolled wide strip breaking-down train, pressing tools are arranged on both sides of the slab edges, wherein the pressing tools are mounted in tool carriers. For forming a reduction drive, each pressing tool is moved together with the corresponding tool carrier in the direction of the width reduction of the slab by means of a lever system actuated by a crank drive, wherein the crank drive is arranged in a crank housing. The crank drive is composed of two driven eccentric shafts, wherein a connecting member is mounted on each eccentric shaft, and wherein the head of the connecting member is connected to the tool carrier for transmitting the upsetting forces. A feed drive operating essentially in slab feeding direction acts on the tool carrier.

The features described above make it possible to separately control the sequence of movement of the pressing tools for the pressing action for reducing the slabs and for the feeding movement of the pressing tool. If the feeding drive is constructed as a hydraulic cylinder, the displacement movement of the hydraulic cylinder can be controlled in a particularly advantageous manner in the form of a distance/time function, so that for each chosen feeding distance, the synchronization of the movement of the pressing tool with the movement of the slab to be pressed laterally is ensured. This upsetting press makes possible the continuous reduction of the width of the slab to values predetermined by rolling technology. The advantageous construction of the upsetting press ensures a high availability, so that the productivity of the rolling mill train in which the upsetting press is arranged is high.

SUMMARY OF THE INVENTION

It is the object of the present invention to further improve the above-described upsetting press. In particular, the maintenance periods are to be reduced and the productivity of the rolling mill train is to be increased further.

In accordance with the present invention, the crank housing with crank drive and feeding drive as well as the tool carrier are combined into a structural unit. This structural unit can be displaced on a rail arrangement laterally and approximately parallel to the slab movement through a housing post window of the horizontal press stand. The unit is displaceable particularly by means of a displacement drive.

During maintenance, for example, when the bearings of the eccentric shafts of the crank drive are checked, the entire structural unit is pushed out of the press and the further disassembly and assembly of the machine elements of the press which are subjected to particularly high loads takes place away from the roller tables on which the hot slabs are transported. If the maintenance operations should require a somewhat longer period of time, the fact that the structural unit has been moved out of the upsetting press and, thus, out of the range of the roller tables, means that space has been made available in the press stand which makes it possible that the slabs can be moved without impairing the operation through the open post window to the subsequent rolling mill stand. As a result, the rolling production in the rolling mill train can be completely resumed in a short time even without press operation, possibly by inserting an upsetting press.

The maintenance and capability of checking the rotating parts of the crank drive which are subjected to high loads is further improved if the structural unit which has been moved out of the upsetting press can be displaced on another rail arrangement approximately transversely of the slab movement. As a result, all machine parts which require intensive maintenance or checking are even more easily accessible. This accessibility and displacement of the structural unit from the upsetting stand is additionally improved if the foundation supports for the spur gear system arranged in a gear housing above the upsetting press are provided only on one side and no foundation support is provided on the stand side facing the assembly site.

In order to stabilize the structural unit during the transport from the upsetting press or into the upsetting press, the tool carrier is connected to the crank housing by means of a support bracket. Since, during operation of the upsetting press, the tool carrier is supported on a carriage with sliding plates arranged in the press stand, the tool carrier must be raised from these sliding plates when the entire structural unit is moved out because the carriage remains in the press stand. Raising of the tool carrier is effected by means of connecting elements of the support bracket, for example, screw connections with wedge-shaped members underneath the connection, wherein the connecting elements are arranged on the crank housing, preferably on the bearing shells of the crank drive.

The crank housing which is guided on sliding plates in the press stand between the housing post members is held on the lower housing post member on both sides by means of heavy guide elements. The guide elements must be removed at least on the side of the assembly site, so that the structural unit can be pushed out of the press stand. In order to avoid extensive assembly operations or disassembly operations, it is proposed that these guide elements remain arranged on the housing post member and can be lowered in direction toward the press foundation by means of an oblong hole guidance, wherein, for this purpose, appropriate screw connections in the oblong holes must be separated.

Moreover, the connection of the crank drive with the cardanic drive shaft arranged between the gear system and the eccentric shaft is separated as closely as possible near the crank housing, so that the entire structural unit can be pushed out of the press housing in as simple a manner as possible and without obstruction. Since the crank housing must be separated within a short time from the displacement device and from the balancing unit resting on the transverse post member before being moved out of the stand, an engageable connection is provided at this location.

In accordance with another further development of the invention, the drives of the entry roller table are arranged on an entry side of the slab into the upsetting press and the drives of the exit roller table are arranged on the oppositely located exit side of the slab from the upsetting press. In addition, the structural unit can be moved from the press stand to that side which is without drive. As a result of this arrangement, the roller table motors can be arranged in that area in which a disassembly of the motors is not required for the removal of the structural unit, so that during the maintenance of the structural unit, for example, of the bearings or the bearing rims, the work roller table remains in operation for the rolling production and the slabs can be moved from the continuous-type furnace through the window of the press stand which is now open to the subsequent rolling mill stand for further processing.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

BRIEF DESCRIPTION OF THE DRAWINGS

The invention will be better understood in connection with the drawings, of which.

DESCRIPTION OF THE PREFERRED EMBODIMENT

Figure 1:
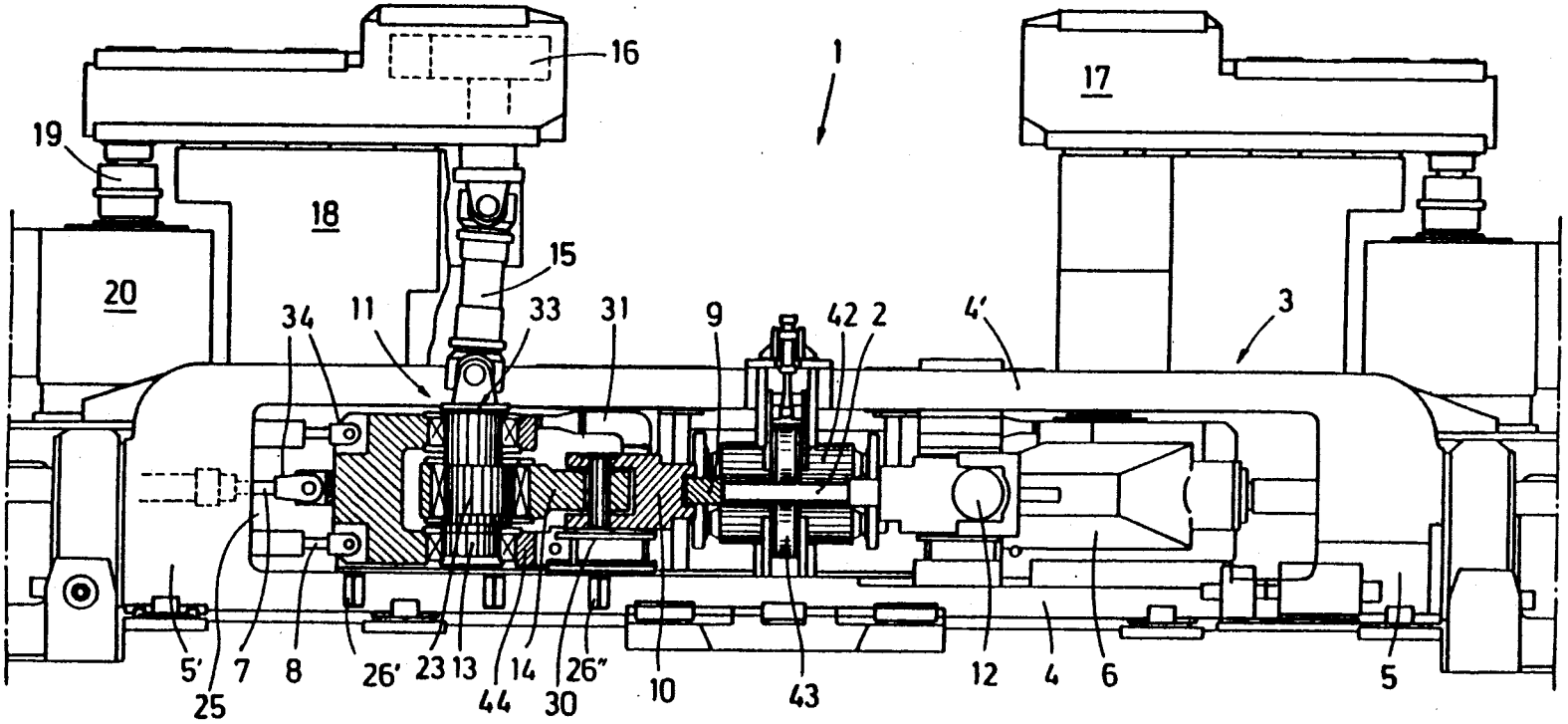
FIG. 1 is a side view, partially in section, of the upsetting press according to the present invention.

FIG. 1 of the drawing is a horizontal, partially sectional view of the flying upsetting press 1 for reducing the width of slabs 2 in a hot-rolled wide strip breaking-down train. The slabs are continuously supplied from a slab casting plant, not shown, arranged in front of the upsetting press. The upsetting press includes a horizontal housing post 3 with upper and lower post members 4, 4' and transverse members 5, 5'. A crank housing 6 is guided in the housing post 3 of the upsetting press 1 by means of a displacement device 7 supported on the post member 5, 5' and by means of a balancing device which is also supported by the post member. The displacement of the crank housing is effected by means of a mechanical adjustment. However, a hydraulically acting piston-cylinder construction can also be used as the displacement device.

Pressing tools 9 are arranged in a tool carrier 10 on both sides of the slab 2. The pressing tool and the tool carrier include a reduction drive 11 acting in a direction extending perpendicularly to the slab 2 and a feeding drive 12 acting in a direction extending parallel to the slab 2. The reduction drive and the feeding drive are arranged in the crank housing 6. The reduction drive is formed by making each tool carrier 10 movable essentially in the direction of the slab 2 whose width has to be reduced, wherein the tool carrier 10 is movable by means of a lever system which includes two connecting members 14 and is actuated by two eccentric shafts 13.

The feeding drive 12 which acts essentially in the direction of the slab feeding direction acts on the tool carrier 10 and is supported on the crank housing 6 in which the two eccentric shafts 13 are mounted. The eccentric shafts are connected to cardanically mounted universal joint shafts 15 which are connected to a spur gear system 16. The gear box 17 is mounted above the upsetting press on a foundation support 18. The input shaft 19 of the spur gear system is coupled to a drive motor 20. The foundation support 18 is placed laterally of the upsetting press 1 on the foundation 21 and cantilevered laterally with a head portion 22 over the upsetting press 1. The cantilevering head portion carries the gear box with the gear system.

Figure 2:
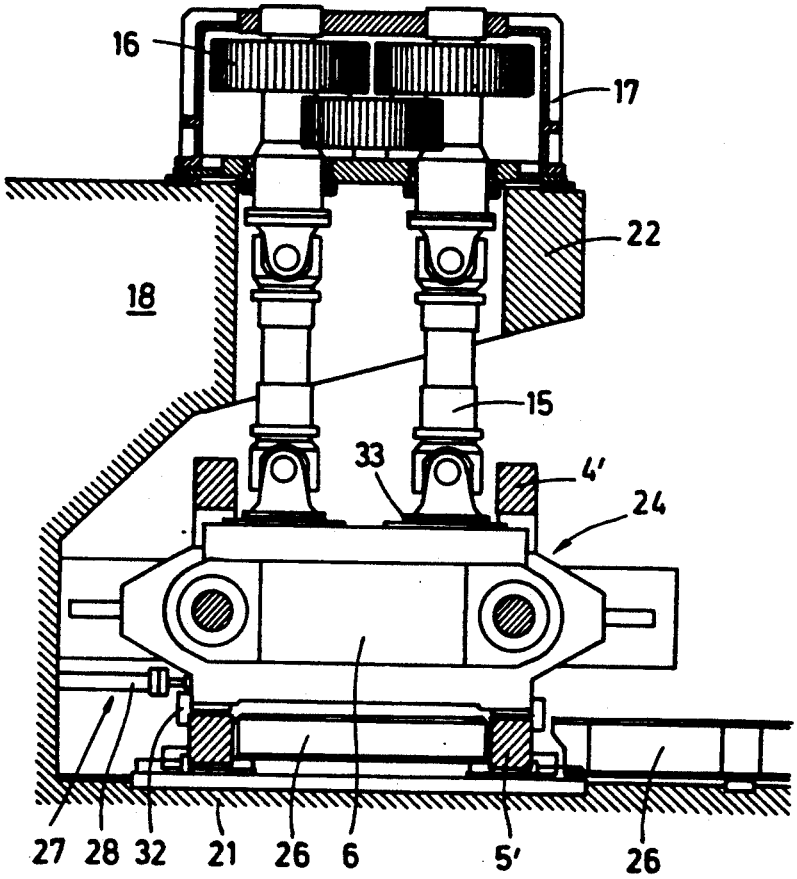
FIG. 2 is a view, on a larger scale, of the crank housing seen in longitudinal direction of the housing post with laterally extending rail arrangement.

As can best be seen in FIG. 2, the crank housing 6 with the crank drive 23 which is arranged in the crank housing and is composed of the eccentric shaft 13 and the connecting member 14 and with the feeding drive 12 and the tool carrier 8 are combined to form a structural unit 24. This structural unit can be displaced laterally and approximately parallel to the slab movement on a rail arrangement 26 through a housing post window 25 of the horizontal press stand 3. In the illustrated embodiment, the rail arrangement 26 includes rail tracks 26' with appropriate rail members which are arranged between the lower post members 4. The rail tracks 26' extend spaced apart from each other and sliding plates are placed on the rail tracks 26'. The displacement of the structural unit 24 is effected by means of a displacement device 27, for example, a piston-cylinder unit 28.

Another rail arrangement 29 extends transversely of the slab movement direction, so that the structural unit 24 can initially be pushed out of the upsetting stand on the rail arrangement 26 parallel to the slab movement and can subsequently be moved on the rail arrangement 29 by a predetermined distance transversely of the slab movement onto a freely accessible assembly site.

The horizontal tool carriers 10 and the connecting members 14 are slidingly supported on a carriage 30 by means of conventional sliding plates, not shown. For stabilizing the structural unit while it is moved out of the upsetting stand, the tool carrier 10 is connected by means of a support bracket 31 to the crank housing 6, preferably to the bearing shells of the crank drive. The tool carrier 10 can be raised from the carriage which is connected to the press stand 3 and supports the tool carrier during operation or from the sliding plates 30 by means of specially constructed connecting elements, for example, a screw connection with appropriately shaped wedges placed under the support brackets.

Figure 3:
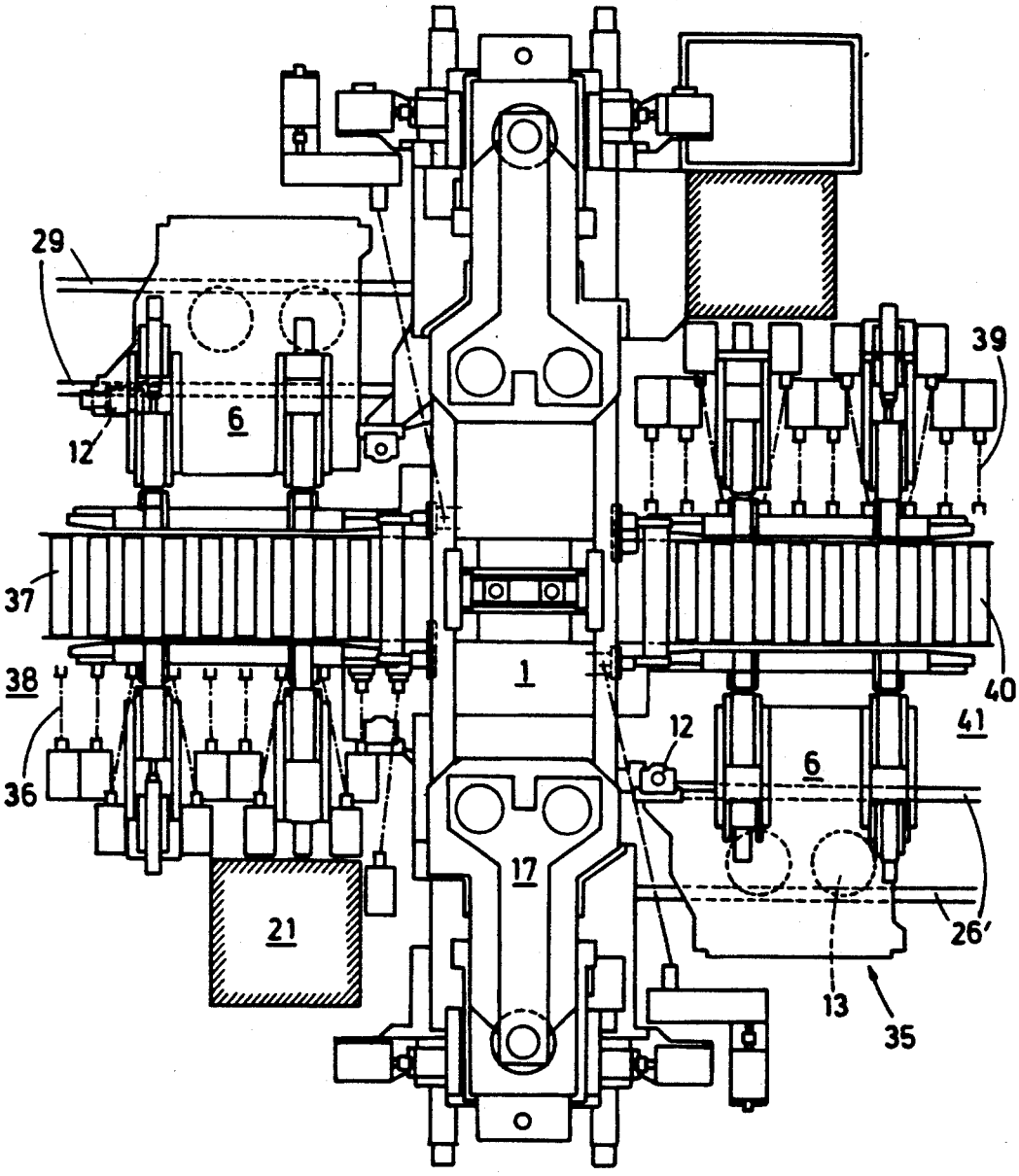
FIG. 3 is a top view of the upsetting press with structural units moved to an assembly site.

The structural unit 24 is prepared for moving out of the press stand by carrying out the following disassembly steps. The guide elements 32 for the crank housing 6 arranged at least on the lower post members 4 of the press stand 3 are lowered in direction toward the press foundation 21 in an oblong hole guide. The separating or connecting device 33 arranged between the crank drive 23 and the driving universal joint shaft 15 is separated. This can be effected by means of a flange connection which is arranged in the area between the upper end of the crank housing 6 and the lower edge of the upper post member 4' of the press stand. Further, the displacement device 7 supporting the crank housing 6 on the transverse post member 5 and the balancing device 8 which is also supported on the post member 5 are separated from the crank housing by means of the engageable connection 34. After all the hydraulic connections have been separated from the structural unit 24, the unit can be moved by the displacement device 27 from the window of the housing posts on the rail arrangement 26 and 29 onto the assembly site 35. As can be seen particularly in FIG. 3, the assembly site 35 is located laterally of the upsetting press 1 and is freely accessible from all sides, so that the maintenance and checking of the machine parts of the structural unit 24 which are subjected to high rolls, such as, bearings, etc., can be carried out unimpeded and quickly.

The free accessibility of the assembly site 35 is achieved by arranging the drive 36 of the entry roller table 37 exclusively on one entry side 38 of the slab 2 into the upsetting press 1, and by arranging the drive 39 of the exit roller table 40 on the oppositely located exit side 41 of the slab 2 from the upsetting press 1, so that the structural unit 24 can be moved out of the press stand to the side which is free of drives. Accordingly, if a longer maintenance period of the structural unit 24 on the assembling site 35 is required, the work roller tables on which the slab 2 is moved to the subsequent rolling mill stands remain operational, so that the rolling production can be carried out without the upsetting press, possibly by moving another upsetting press into the pitch line.

The assembly of the structural unit 24 in the upsetting press 1 is effected by carrying out the above-described disassembly steps in the reverse sequence. The structural unit 24 is moved from the assembly site 35 on the rail arrangements 29, 26 into the housing post window of the housing post 3 and the guide elements 32 are pulled upwardly and anchored laterally in the oblong hole guide. The balancing device and the displacement device are coupled to the crank housing, the connecting device of universal joint shafts 15 and eccentric shafts 13 is coupled and the support bracket 31 which stabilizes the tool carrier 10 is separated together with the connecting elements in such a way that the tool carrier is lowered onto the sliding plates 30. The upsetting press is now ready for operation.

FIG. 1 of the drawing shows the slab 2 arranged between the pressing tools 9. During operation, the slab 2 is moved through the upsetting press by means of driving rolls 43 arranged on the entry side 38 and on the exit side 41. The slab 2 is guided during the upsetting operation by means of support rolls 43 arranged above and below the slab in order to avoid warping or bulging of the slab.

It is apparent that the above-described features meet the objects mentioned above technically and economically in an advantageous manner and that, as a result, the availability of the upsetting press and the productivity of a rolling mill train, particularly of a hot-rolled wide strip breaking-down train, are increased.

While a specific embodiment of the invention has been shown and described in detail to illustrate the application of the inventive principle, it will be understood that the invention may be embodied otherwise without departing from such principles.

I claim:

1. An upsetting press for reducing the width of rolled material, particularly for reducing the width of slabs in hot-rolled wide strip breaking-down trains, comprising:

tools carried arranged on both sides of the slab and including pressing tools;

at least one crank drive for moving the pressing tools in direction of slab reduction, the crank drive and a feeding drive arranged in a crank housing, wherein the crank housing with crank drive and feeding drive and the tool carrier are combined into a structural unit;

a housing post having a housing window; and a rail arrangement for displacing the structural unit laterally and approximately parallel to the slab movement through the housing post window.

2. The upsetting press of claim 1, further comprising a displacement drive for displacing the structural unit.

3. The upsetting press claim 1, further comprising an additional rail arrangement for displacing the structural unit which has been moved out of the upsetting press in a direction extending approximately transversely of the slab movement.

4. The upsetting press of claim 1, further comprising a support bracket connecting the tool carrier to the crank housing for stabilizing the structural unit.

5. The upsetting press of claim 4, wherein the support bracket, further comprises:

connecting elements arranged on the crank housing;

sliding plates connected to a press stand and supporting the tool carrier during operation, wherein the tool carrier is raisable from the sliding plates by connecting elements of the support bracket.

6. The upsetting press of claim 5, wherein the connecting elements are attached to bearing shells of the crank drive.

7. The upsetting press of claim 5, wherein the press stand, further comprises lower post members and transverse post members comprising guide elements for the crank housing mounted on at least the lower post members, wherein the guide elements are lowerable toward a press foundation.

8. The upsetting press of claim 7, further comprising an oblong hole guide means for lowering the guide elements.

9. The upsetting press of claim 7, wherein the crank drive and a universal joint shaft driving the crank drive comprise a separating and connecting device mounted between an upper edge of the crank housing and a lower edge of the upper post member.

10. The upsetting press of claim 7, further comprising an engageable coupling means for connecting the crank housing to a displacement device supported on the transverse member as well as to a balancing device which is also supported on the transverse member.

11. The upsetting press of claim 1, further comprising:

drives for an entry roller table on an entry side of the slab into the upsetting press; and drives for an exit roller table on an oppositely located exit side of the slab from the upsetting press, wherein the structural unit is movable out of the upsetting press onto a side of the slabs opposite the drives which is free of drives.

* * * * *